US009589492B2

(12) United States Patent
Feng

(10) Patent No.: US 9,589,492 B2
(45) Date of Patent: Mar. 7, 2017

(54) PIXEL ARRAY, DISPLAY AND METHOD FOR PRESENTING IMAGE ON THE DISPLAY

(71) Applicant: EverDisplay Optronics (Shanghai) Limited, Shanghai (CN)

(72) Inventor: Yuhsiung Feng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 116 days.

(21) Appl. No.: 14/171,563

(22) Filed: Feb. 3, 2014

(65) Prior Publication Data

US 2015/0015466 A1 Jan. 15, 2015

(30) Foreign Application Priority Data

Jul. 12, 2013 (CN) ..... 2013 1 0294507
Aug. 5, 2013 (CN) ..... 2013 1 0338376

(51) Int. Cl.
*G09G 3/00* (2006.01)
*G09G 3/34* (2006.01)
(Continued)

(52) U.S. Cl.
CPC ..... *G09G 3/2003* (2013.01); *G09G 3/007* (2013.01); *G09G 3/2983* (2013.01);
(Continued)

(58) Field of Classification Search
CPC ..... G09G 3/22; G09G 3/3208; G09G 3/30; G09G 3/3225; G09G 3/3233;
(Continued)

(56) References Cited

U.S. PATENT DOCUMENTS 5,311,337 A * 5/1994 McCartney, Jr. ..... 349/145
6,714,206 B1 * 3/2004 Martin et al. ..... 345/589
(Continued)

FOREIGN PATENT DOCUMENTS

CN 200971176 Y 11/2007
EP 2590156 A1 5/2013
(Continued)

OTHER PUBLICATIONS

"First Office Action" issued by the State Intellectual Property Office of The People's Republic of China on Aug. 28, 2014 for Application No. 201310338376.9.
(Continued)

*Primary Examiner* — Kent Chang
*Assistant Examiner* — William Lu
(74) *Attorney, Agent, or Firm* — Yunling Ren

(57) ABSTRACT

The present disclosure provides a pixel array, a display including the pixel array and a method for presenting an image on the display. The pixel array is composed of a plurality of basic pixel units repeated in horizontal and vertical directions. Each of the basic pixel units includes a first pixel point, a second pixel point and a third pixel point arranged from top to bottom. The first pixel point is composed of a first sub-pixel and a second sub-pixel located in two horizontal rows. The second pixel point is composed of a third sub-pixel and a first sub-pixel located in two horizontal rows. The third pixel point is composed of a second sub-pixel and a third sub-pixel located in two horizontal rows. With the solutions of the present disclosure, accuracy and yield of evaporation and image resolution may be improved.

13 Claims, 15 Drawing Sheets

(51) Int. Cl.
*G09G 3/20* (2006.01)
*G09G 3/298* (2013.01)
*G09G 3/32* (2016.01)

(52) U.S. Cl.
CPC ... *G09G 3/3225* (2013.01); *G09G 2300/0452* (2013.01); *G09G 2310/0262* (2013.01); *G09G 2340/0457* (2013.01); *G09G 2360/16* (2013.01)

(58) Field of Classification Search
CPC .. G09G 3/3241; G09G 3/3266; G09G 3/3275; G09G 3/3258
See application file for complete search history.

(56) References Cited

U.S. PATENT DOCUMENTS 6,950,115 B2 * 9/2005 Brown Elliott ..... 345/694
7,045,963 B2 * 5/2006 Chen ..... H01J 11/12 313/582
7,728,802 B2 * 6/2010 Brown Elliott ..... G09G 3/3607 345/694
8,310,412 B2 * 11/2012 Yamada ..... G09G 3/296 345/63
8,854,289 B2 * 10/2014 Yin ..... G09G 3/20 345/204
9,093,018 B2 * 7/2015 Tsuchiya ..... G09G 3/2011
2002/0070909 A1 * 6/2002 Asano et al. ..... 345/76
2002/0126074 A1 * 9/2002 Ouellette ..... G09G 3/20 345/87
2002/0140713 A1 * 10/2002 Klompenhouwer . G09G 3/2003 345/690
2003/0034992 A1 * 2/2003 Brown Elliott et al. ..... 345/690
2004/0212633 A1 * 10/2004 Natori ..... G09F 9/33 345/694
2005/0140634 A1 * 6/2005 Takatori ..... G09G 3/3655 345/96
2005/0225563 A1 * 10/2005 Brown Elliott ..... G09G 5/02 345/604
2008/0170083 A1 * 7/2008 Han ..... G09G 5/377 345/589
2010/0045695 A1 * 2/2010 Brown Elliott et al. ..... 345/589
2011/0273494 A1 * 11/2011 Jun ..... 345/694
2013/0002118 A1 * 1/2013 Ko ..... 313/1
2013/0038513 A1 * 2/2013 Park ..... H01L 27/3218 345/55
2013/0113363 A1 * 5/2013 Hong ..... 313/498
2014/0071175 A1 * 3/2014 Yang et al. ..... 345/690

FOREIGN PATENT DOCUMENTS

JP 2005345766 A 12/2005
JP 2008152080 A 7/2008
JP 2009186745 A 8/2009
JP 2010010112 A 1/2010
JP 2010026426 A 2/2010
JP 2013097371 A 5/2013
KR 20060114477 A 11/2006
KR 10-20130007309 A 1/2013
TW 522749 B 3/2003

OTHER PUBLICATIONS

"First Office Action" issued by the Japanese Patent Office on Jan. 7, 2015.
"First Office Action" issued by the Korean Intellectual Property Office dated Dec. 27, 2014.
Intellectual Property Office, Ministry of Economic Affairs, R.O.C., "First Office Action" dated Jan. 20, 2015, Taiwan.
2nd Office Action issued Apr. 14, 2015 by the KR Office.
3rd Office Action issued Aug. 11, 2015 by the KR Office.

* cited by examiner

| | | | | | | | | | | | | | | | |
|---|---|---|---|---|---|---|---|---|---|---|---|---|---|---|---|
| B | G | B | G | B | G | B | G | B | G | B | G | B | G | B | G |
| G | R | G | R | G | R | G | R | G | R | G | R | G | R | G | R |
| B | G | B | G | B | G | B | G | B | G | B | G | B | G | B | G |
| G | R | G | R | G | R | G | R | G | R | G | R | G | R | G | R |
| B | G | B | G | B | G | B | G | B | G | B | G | B | G | B | G |
| G | R | G | R | G | R | G | R | G | R | G | R | G | R | G | R |
| B | G | B | G | B | G | B | G | B | G | B | G | B | G | B | G |
| G | R | G | R | G | R | G | R | G | R | G | R | G | R | G | R |
| B | G | B | G | B | G | B | G | B | G | B | G | B | G | B | G |
| G | R | G | R | G | R | G | R | G | R | G | R | G | R | G | R |
| B | G | B | G | B | G | B | G | B | G | B | G | B | G | B | G |
| G | R | G | R | G | R | G | R | G | R | G | R | G | R | G | R |

Fig. 1(a)

PIXEL ARRAY, DISPLAY AND METHOD FOR PRESENTING IMAGE ON THE DISPLAY

CROSS REFERENCE TO RELATED APPLICATIONS

The present application claims priority under 35 U.S.C. §119 to Chinese Patent Applications No. 201310294507.8 and No. 201310338376.9, filed on Jul. 12, 2013 and Aug. 5, 2013 respectively, the entire contents of which are incorporated herein by reference.

TECHNICAL FIELD

The present disclosure relates to the display technical field, and more particular to a pixel array, a display including the pixel array and a method for presenting an image on the display.

BACKGROUND

Active Matrix Organic Light Emitting Diode (hereinafter referred to as AMOLED) is a new generation display. FIGS. 1(*a*)~1(*e*) are schematic diagrams showing various pixel arrays of an AMOLED display in conventional technologies.

A pixel unit of a conventional pixel array is composed of three sub-pixels, i.e., a red sub-pixel, a green sub-pixel and a blue sub-pixel. However, existing pixel array designs of AMOLED tend to use arrangements such as PenTile technique. In a PenTile pixel array, there are different single pixel points (or referred to as pixel units), one kind is red-green and another kind is blue-green. As we know, only three primary colors can form all colors, and two colors cannot form all colors. Thus, when an image is actually displayed, one pixel unit of the PenTile array may "borrow" one color of an adjacent pixel unit to form the three primary colors. In a horizontal direction, each pixel unit shares a sub-pixel having a color absent in the pixel unit with an adjacent pixel unit so as to cooperatively realize a white display effect.

At present, AMOLEDs experience bottlenecks in high resolution products. A mainstream evaporation technique for AMOLED is Fine Metal Mask (FMM), and for a product having a resolution over 200 Pixel Per Inch (PPI), when a normal pixel arrangement (for example, a stripe arrangement) is employed, the evaporation accuracy of FMM will cause a problem of color mixture (i.e., a problem of low yield) in the product.

Accordingly, manners for rendering pixel array such as an atypical PenTile pixel arrangement have emerged, and with these manners, ⅓ of sub-pixels may be saved and thereby the problem of poor FMM evaporation accuracy may be solved. However, the PenTile arrangement is different from the arrangement of real RGB sub-pixels after all; due to sharing of sub-pixels, blurring effects will occur at edges of non-continuous area of an image. Furthermore, the PenTile pixel arrangement or the atypical PenTile pixel arrangement may cause a problem of rough edges of an image.

SUMMARY

Thus, the present disclosure provides a novel pixel array, a display including the pixel array and a method for presenting an image on the display. With the technical solutions of the present disclosure, sub-pixels may be saved, the drawback of blurring effects at edges of an image in conventional pixel arrays may be overcome, and meanwhile the evaporation accuracy, the evaporation yield and the image resolution may be improved.

Aiming at the problems existing in conventional technologies, one aspect of the present disclosure provides a pixel array composed of a plurality of basic pixel units which are repeated in a horizontal direction and a vertical direction, wherein each of the basic pixel units may include a first pixel point, a second pixel point and a third pixel point which are arranged from top to bottom, the first pixel point may be composed of a first sub-pixel of a first color and a second sub-pixel of a second color which are respectively located in two horizontal rows, the second pixel point may be composed of a third sub-pixel of a third color and a first sub-pixel of the first color which are respectively located in two horizontal rows, and the third pixel point may be composed of a second sub-pixel of the second color and a third sub-pixel of the third color which are respectively located in two horizontal rows. The first sub-pixel in the first pixel point, the third sub-pixel in the second pixel point, and the second sub-pixel in the third pixel point may be arranged in sequence from top to bottom in the vertical direction at a first interval to form a first column. The second sub-pixel in the first pixel point, the first sub-pixel in the second pixel point, and the third sub-pixel in the third pixel point may be arranged in sequence from top to bottom in the vertical direction at the first interval to form a second column. The second column may be separated from the first column by a second interval in the horizontal direction.

According to an embodiment, the first interval may be smaller than a height of one sub-pixel.

According to an embodiment, the second interval may be greater than or equal to zero.

According to an embodiment, a horizontal interval between two sub-pixels which are located at positions corresponding to one another in two adjacent basic pixel units in the horizontal direction of the pixel array, may be greater than or equal to a width of one sub-pixel.

According to an embodiment, a vertical interval between two sub-pixels which are located at positions corresponding to one another in two adjacent basic pixel units in the vertical direction of the pixel array, may be smaller than a height of five sub-pixels.

According to an embodiment, the first sub-pixel, the second sub-pixel and the third sub-pixel may respectively have a shape selected from a group consisting of rectangle, circle, diamond and regular hexagon.

According to an embodiment, the first color, the second color and the third color may be blue, red and green respectively.

According to an embodiment, the first color, the second color and the third color may be blue, green and red respectively.

According to an embodiment, an area of the first sub-pixel may be equal to an area of the second sub-pixel, and an area of the third sub-pixel may be 75%~85% to the area of the first sub-pixel.

According to an embodiment, a row of sub-pixels having the same color in the pixel array may be provided with signals by a scan driver, and a column of sub-pixels having different colors in the pixel array may be provided with signals by a data driver.

Another aspect of the present disclosure provides a display including: a base having a pixel area and a non-pixel area, wherein a pixel array in the pixel area may be composed of a plurality of basic pixel units which are repeated in a horizontal direction and a vertical direction, wherein each of the basic pixel units may include a first pixel point, a second pixel point and a third pixel point which are arranged from top to bottom, the first pixel point may be composed of a first sub-pixel of a first color and a second sub-pixel of a second color which are respectively located in two horizontal rows, the second pixel point may be composed of a third sub-pixel of a third color and a first sub-pixel of the first color which are respectively located in two horizontal rows, and the third pixel point may be composed of a second sub-pixel of the second color and a third sub-pixel of the third color which are respectively located in two horizontal rows, and wherein: the first sub-pixel in the first pixel point, the third sub-pixel in the second pixel point, and the second sub-pixel in the third pixel point may be arranged in sequence from top to bottom in the vertical direction at a first interval to form a first column; the second sub-pixel in the first pixel point, the first sub-pixel in the second pixel point, and the third sub-pixel in the third pixel point may be arranged in sequence from top to bottom in the vertical direction at the first interval to form a second column; and the second column may be separated from the first column by a second interval in the horizontal direction; an Organic Light Emitting Diode (OLED) located in the pixel area and including a first electrode, an organic film layer and a second electrode;

a driver configured to drive the OLED and including:

an input unit configured to input image signals representative of a color image to be presented on the display;

a sub-pixel painting unit configured to generate an intensity map which includes intensity values of each first sub-pixel, each second sub-pixel and each third sub-pixel of the display; and an output unit configured to output a plurality of electrical signals generated according to the intensity map to the display.

According to an embodiment, the driver may further include: a brightness mapping unit configured to receive the color image from the input unit and to generate a brightness map of the color image, wherein the brightness map may include brightness values of each first sub-pixel, each second sub-pixel and each third sub-pixel; and a pattern estimation unit electrically connected between the brightness mapping unit and the sub-pixel painting unit and configured to analyze the brightness map to estimate at least one pattern of the color image and to generate at least one color template for each pattern.

According to an embodiment, the driver may further include: a brightness buffer electrically connected between the sub-pixel painting unit and the output unit and configured to receive and buffer the intensity map output from the sub-pixel painting unit.

According to an embodiment, the at least one pattern may include a dot pattern, and wherein the color template corresponding to the dot pattern may include: a first sub-pixel at a center of the color template corresponding to the dot pattern and having a first brightness value; a second sub-pixel in a sub-pixel row next to the first sub-pixel and having a second brightness value; and a third sub-pixel in a sub-pixel row preceding the first sub-pixel and having a third brightness value.

According to an embodiment, the first sub-pixel and the second sub-pixel may form a pixel point.

According to an embodiment, the first interval may be smaller than a height of one sub-pixel.

According to an embodiment, the second interval may be greater than or equal to zero.

According to an embodiment, a horizontal interval between two sub-pixels which are located at positions corresponding to one another in two adjacent basic pixel units in the horizontal direction of the pixel array, may be greater than or equal to a width of one sub-pixel.

According to an embodiment, a vertical interval between two sub-pixels which are located at positions corresponding to one another in two adjacent basic pixel units in the vertical direction of the pixel array, may be smaller than a height of five sub-pixels.

According to an embodiment, the first sub-pixel, the second sub-pixel and the third sub-pixel may respectively have a shape selected from a group consisting of rectangle, circle, diamond and regular hexagon.

According to an embodiment, the first color, the second color and the third color may be blue, red and green respectively.

According to an embodiment, the first color, the second color and the third color may be blue, green and red respectively.

According to an embodiment, an area of the first sub-pixel may be equal to an area of the second sub-pixel, and an area of the third sub-pixel may be 75%~85% to the area of the first sub-pixel.

According to an embodiment, a row of sub-pixels having the same color in the pixel array may be provided with signals by a scan driver, and a column of sub-pixels having different colors in the pixel array may be provided with signals by a data driver.

A further aspect of the present disclosure provides a method for presenting an image on a display, wherein the display has a pixel array which may be composed of a plurality of basic pixel units which are repeated in a horizontal direction and a vertical direction, wherein each of the basic pixel units may include a first pixel point, a second pixel point and a third pixel point which are arranged from top to bottom, the first pixel point may be composed of a first sub-pixel of a first color and a second sub-pixel of a second color which are respectively located in two horizontal rows, the second pixel point may be composed of a third sub-pixel of a third color and a first sub-pixel of the first color which are respectively located in two horizontal rows, and the third pixel point may be composed of a second sub-pixel of the second color and a third sub-pixel of the third color which are respectively located in two horizontal rows, wherein: the first sub-pixel in the first pixel point, the third sub-pixel in the second pixel point, and the second sub-pixel in the third pixel point may be arranged in sequence from top to bottom in the vertical direction at a first interval to form a first column; the second sub-pixel in the first pixel point, the first sub-pixel in the second pixel point, and the third sub-pixel in the third pixel point may be arranged in sequence from top to bottom in the vertical direction at the first interval to form a second column; and the second column may be separated from the first column by a second interval in the horizontal direction; wherein the method may include: (a) inputting image signals representative of a color image to be presented on the display; (b) generating an intensity map which includes intensity values of each first sub-pixel, each second sub-pixel and each third sub-pixel of the display; and (c) outputting a plurality of electrical signals generated according to the intensity map to the display.

According to an embodiment, after step (a) and before step (b), the method may further include: generating a brightness map of the color image, wherein the brightness map may include brightness values of each first sub-pixel, each second sub-pixel and each third sub-pixel; and analyzing the brightness map to estimate at least one pattern of the color image and generating at least one color template for each pattern, wherein the at least one color template is used to generate the intensity map.

According to an embodiment, after step (b) and before step (c), the method may further include receiving and buffer the intensity map.

According to an embodiment, the at least one pattern may include a dot pattern, and wherein the color template corresponding to the dot pattern includes: a first sub-pixel at a center of the color template corresponding to the dot pattern and having a first brightness value; a second sub-pixel in a sub-pixel row next to the first sub-pixel and having a second brightness value; and a third sub-pixel in a sub-pixel row preceding the first sub-pixel and having a third brightness value.

According to an embodiment, the first sub-pixel and the second sub-pixel may form a pixel point.

According to an embodiment, the first interval may be smaller than a height of one sub-pixel.

According to an embodiment, the second interval may be greater than or equal to zero.

According to an embodiment, a horizontal interval between two sub-pixels which are located at positions corresponding to one another in two adjacent basic pixel units in the horizontal direction of the pixel array, may be greater than or equal to a width of one sub-pixel.

According to an embodiment, a vertical interval between two sub-pixels which are located at positions corresponding to one another in two adjacent basic pixel units in the vertical direction of the pixel array, may be smaller than a height of five sub-pixels.

According to an embodiment, the first sub-pixel, the second sub-pixel and the third sub-pixel may respectively have a shape selected from a group consisting of rectangle, circle, diamond and regular hexagon.

According to an embodiment, the first color, the second color and the third color may be blue, red and green respectively.

According to an embodiment, the first color, the second color and the third color may be blue, green and red respectively.

According to an embodiment, an area of the first sub-pixel may be equal to an area of the second sub-pixel, and an area of the third sub-pixel may be 75%~85% to the area of the first sub-pixel.

According to an embodiment, a row of sub-pixels having the same color in the pixel array may be provided with signals by a scan driver, and a column of sub-pixels having different colors in the pixel array may be provided with signals by a data driver.

The present disclosure at least has the following advantageous effects: sub-pixels may be saved, the drawback of blurring effects at edges of an image in conventional pixel arrays may be overcome, and meanwhile the evaporation accuracy, the evaporation yield and the image resolution may be improved.

BRIEF DESCRIPTION OF THE DRAWINGS

FIG. 4(*b*) is a schematic diagram showing a pixel array according to a second embodiment of the present disclosure;

FIG. 5(*b*) is a schematic diagram showing a pixel array according to a fourth embodiment of the present disclosure;

FIG. 5(*c*) is an exemplary schematic diagram showing a pixel array according to a fifth embodiment of the present disclosure;

DESCRIPTION OF THE EMBODIMENTS

Typical embodiments reflecting features and advantages of the present disclosure will be described in detail hereinafter. It shall be understood that, various modifications may be made on different embodiments and will not depart from the scope of the present disclosure, and the description herein and drawings shall be considered as illustrative but not for limiting the present disclosure.

A pixel array according to an embodiment of the present disclosure may be applied to a display according to an embodiment of the present disclosure; the display according to an embodiment of the present disclosure may have the pixel array according to an embodiment of the present disclosure; and a method for presenting (or referred to as a rendering method) according to an embodiment of the present disclosure may be applied to the display according to an embodiment of the present disclosure. Preferably, the display according to the present disclosure may be a display of a mobile phone, and more preferably may be an AMOLED display used in a mobile phone.

Figure 1B:
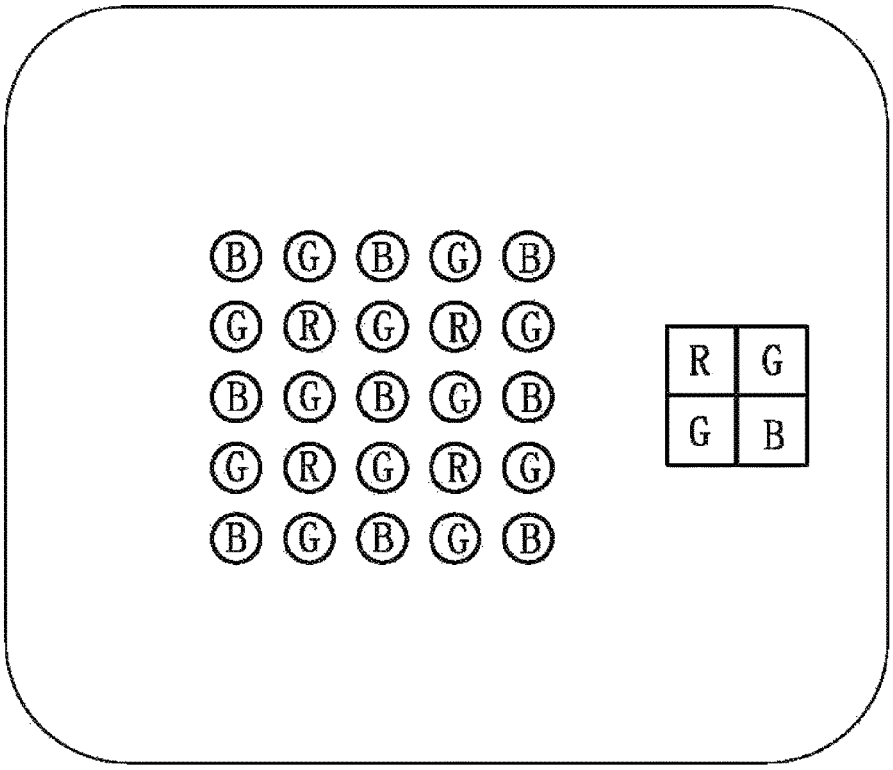
FIGS. 1(*a*)~1(*e*) are schematic diagrams showing various pixel arrays of an AMOLED display in conventional technologies.
Figure 1C:
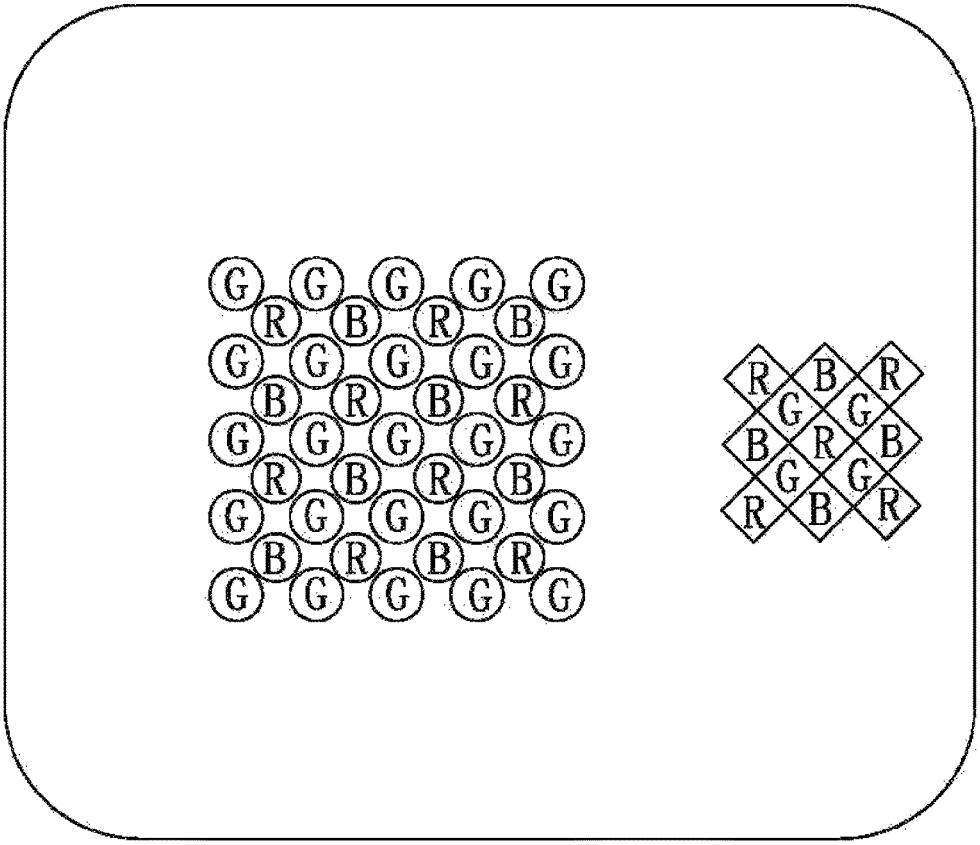
Figure 1D:
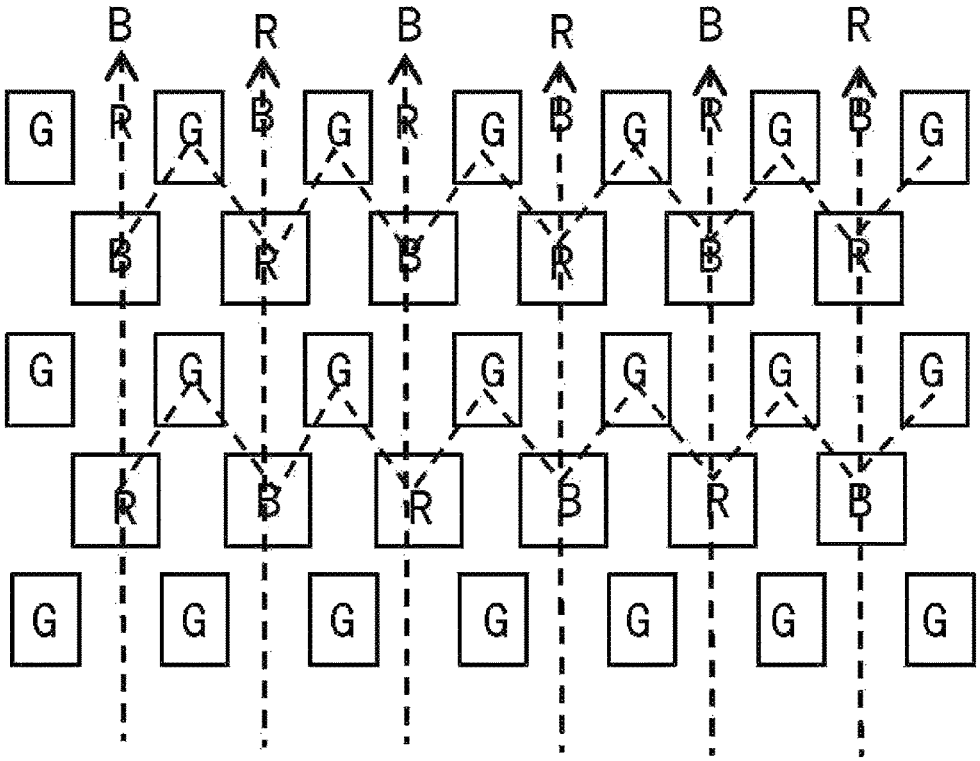
Figure 1E:
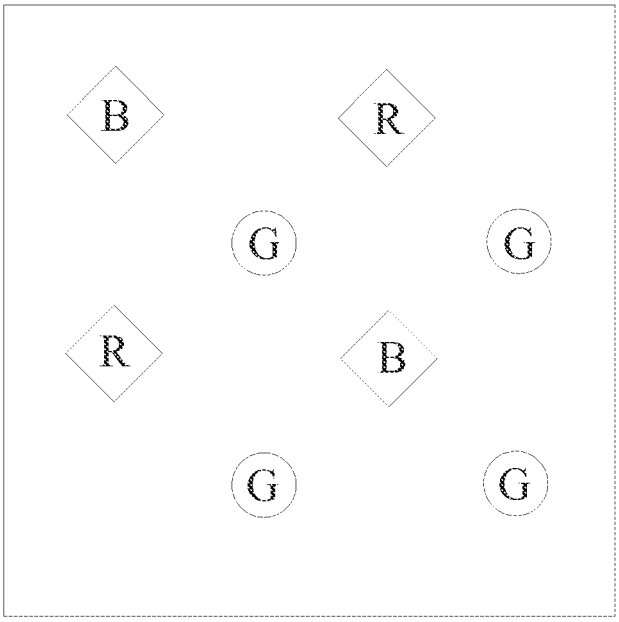
Figure 2:
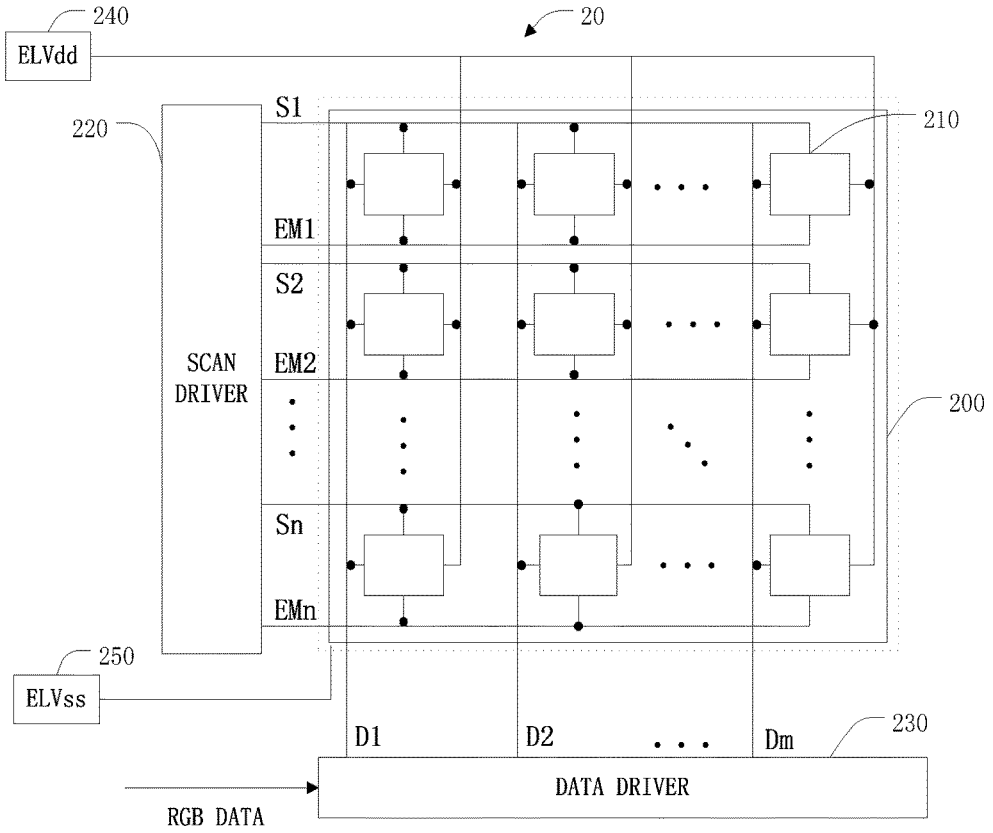
FIG. 2 is a schematic diagram showing a display device according to the present disclosure.

FIG. 2 is a schematic diagram showing a display device according to the present disclosure. The display device is an OLED display device 20. Referring to FIG. 2, the OLED display device 20 at least includes a display unit 200, a scan driver 220 and a data driver 230. The OLED display device 20 may also include other devices and/or elements.

The display unit 200 may include a plurality of pixel points 210 connected to scan lines (S1 to Sn), light emitting control lines (EM1 to EMn) and data lines (D1 to Dm). Furthermore, one pixel point 210 may have one OLED and may be composed of two sub-pixels which respectively emit light of different colors (for example, red and green; red and blue; or green and blue).

The display unit 200 may display an image so as to correspond to a first power source (ELVdd) provided from outside and a second power source (ELVss) provided from outside. The display unit 200 may further display images corresponding to scan signals provided by the scan lines S1 to Sn and generated by the scan driver 220, light emitting control signals provided by the light emitting control lines EM1 to EMn, and data signals provided by the data lines D1 to Dm and generated by the data driver 230.

The scan driver 220 may generate the scan signals and the light emitting control signals. The scan signals generated by the scan driver 220 may be sequentially provided to the scan lines (S1 to Sn), and the light emitting control signals may be sequentially provided to each of the light emitting control lines (EM1 to EMn). The scan signals and the light emitting control signals may also be respectively provided to the scan lines S1 to Sn and the light emitting control lines EM1 to EMn out of sequence. In other embodiments, the light emitting control signals may also be generated by a light emitting control driver.

The data driver 230 may receive input signals such as RGB data, and may generate data signals corresponding to the received input signals. The data signals generated by the data driver 230 may be provided to the pixel point 210 via the data lines (D1 to Dm) so as to synchronize with the scan signals. The data signals may also be provided to the data lines D1 to Dm out of sync with the scan signals.

Actually, two sub-pixels present one pixel point 210 in the pixel array according to the embodiments of the present disclosure. The pixel array will be illustrated in more detail with reference to FIGS. 3~6.

Figure 3:
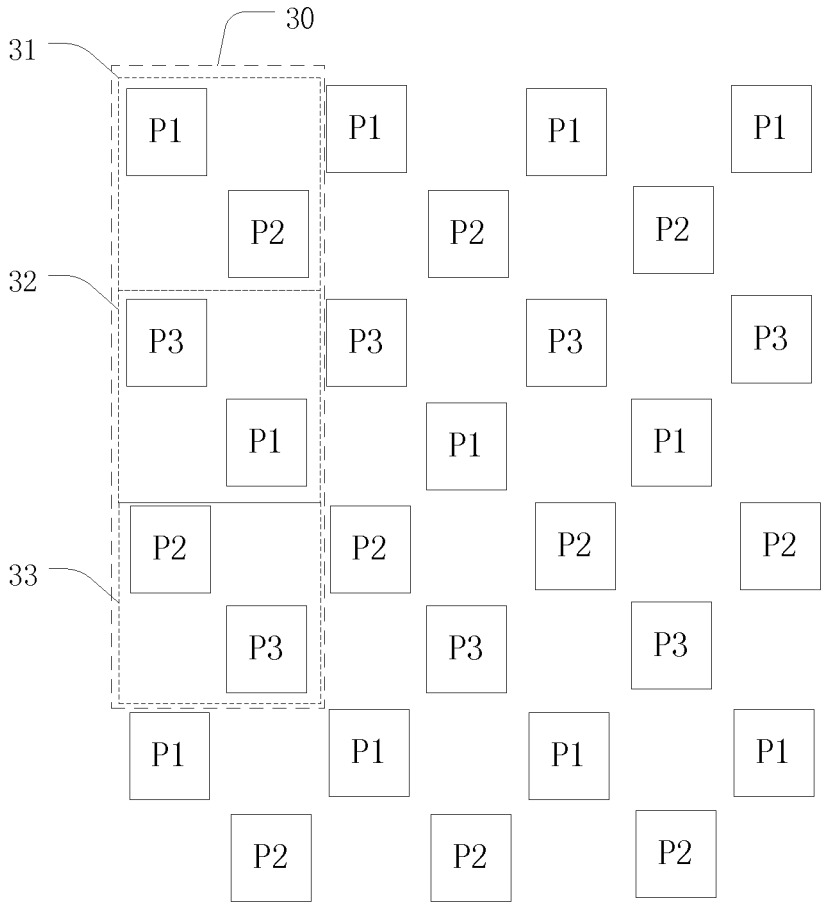
FIG. 3 is a schematic diagram showing a pixel array according to the present disclosure.

FIG. 3 is a schematic diagram showing a pixel array according to the present disclosure. As shown in FIG. 3, the pixel array is composed of a plurality of basic pixel units which are repeated in a horizontal direction and a vertical direction. Each basic pixel unit 30 may include a first pixel point 31, a second pixel point 32 and a third pixel point 33 which are arranged from top to bottom. The first pixel point 31 is composed of a first sub-pixel P1 of a first color and a second sub-pixel P2 of a second color which are respectively located in two horizontal rows. The second pixel point 32 is composed of a third sub-pixel P3 of a third color and a first sub-pixel P1 of the first color which are respectively located in two horizontal rows. The third pixel point 33 is composed of a second sub-pixel P2 of the second color and a third sub-pixel P3 of the third color which are respectively located in two horizontal rows. The first sub-pixel P1 in the first pixel point 31, the third sub-pixel P3 in the second pixel point 32 and the second sub-pixel P2 in the third pixel point 33 are arranged in sequence from top to bottom in the vertical direction at a first interval to form a first column. The second sub-pixel P2 in the first pixel point 31, the first sub-pixel P1 in the second pixel point 32, and the third sub-pixel P3 in the third pixel point 33 are arranged in sequence from top to bottom in the vertical direction at the first interval to form a second column. The second column is separated from the first column by a second interval in the horizontal direction.

More specifically, the first interval is smaller than a height of one sub-pixel. That is, an interval between the first sub-pixel P1 in the first pixel point 31 and the third sub-pixel P3 in the second pixel point 32 is smaller than a height of one sub-pixel; an interval between the third sub-pixel P3 in the second pixel point 32 and the second sub-pixel P2 in the third pixel point 33 is also smaller than a height of one sub-pixel. Similarly, an interval between the second sub-pixel P2 in the first pixel point 31 and the first sub-pixel P1 in the second pixel point 32 is also smaller than a height of one sub-pixel; an interval between the first sub-pixel P1 in the second pixel point 32 and the third sub-pixel P3 in the third pixel point 33 is also smaller than a height of one sub-pixel (although the interval shown in this figure is approximately equal to a height of one sub-pixel).

More specifically, the second interval is greater than or equal to zero. That is, a horizontal interval between two sub-pixels which are located at positions corresponding to one another in two adjacent basic pixel units in the horizontal direction of the pixel array, is greater than or equal to a width of one sub-pixel. For example, as shown in this figure, in the first row, an interval between the first sub-pixel P1 in the first pixel point 31 and a first sub-pixel P1 in an adjacent pixel point in the horizontal direction is greater than or equal to a width of one sub-pixel, so that the interval in the horizontal direction between the first sub-pixel P1 and the second sub-pixel P2 of the first pixel point is greater than or equal to zero.

More specifically, a vertical interval between two sub-pixels which are located at positions corresponding to one another in two adjacent basic pixel units in the vertical direction of the pixel array, is smaller than a height of five sub-pixels. For example, as shown in this figure, an interval between the first sub-pixel P1 of the first pixel point 31 in the first row and a first sub-pixel P1 (the first P1 in the seventh row as shown in this figure) of a first pixel point in an adjacent basic pixel unit in the vertical direction is smaller than a height of five sub-pixels, so that an interval in the vertical direction between the first sub-pixel P1 in the first pixel point 31 and the third sub-pixel P3 in the second pixel point 32 and an interval in the vertical direction between the third sub-pixel P3 in the second pixel point 32 and the second sub-pixel P2 in the third pixel point 33 are smaller than a height of one sub-pixel, respectively.

More specifically, the first pixel point 31, the second pixel point 32 and the third pixel point 33 corresponds to the pixel point 210 shown in FIG. 2. Since the interval between two adjacent first sub-pixels P1 in the row direction, the interval between two adjacent second sub-pixels P2 in the row direction and the interval between two adjacent third sub-pixels P3 in the row direction are greater than or equal to a width of one sub-pixel, color mixture will not occur between the sub-pixels P1 and P2 that constitute the first pixel point 31, between the sub-pixels P3 and P1 that constitute the second pixel point 32 and between the sub-pixels P2 and P3 that constitute the third pixel point 33. Since only three primary colors can form all colors and two colors cannot form all colors, when an image is actually displayed, one pixel point may "borrow" one color of an adjacent pixel unit to form the three primary colors. If scanning is performed by row from top to bottom, since the pixel point 32 lacks a second sub-pixel, the pixel point 32 may borrow the second sub-pixel P2 from the upper pixel point 31 which is adjacent to the pixel point 32 in the vertical direction. Thus, each pixel point shares a sub-pixel having a color absent in the pixel point with an adjacent pixel point in the vertical direction so as to cooperatively realize a white display effect.

Figure 4A:
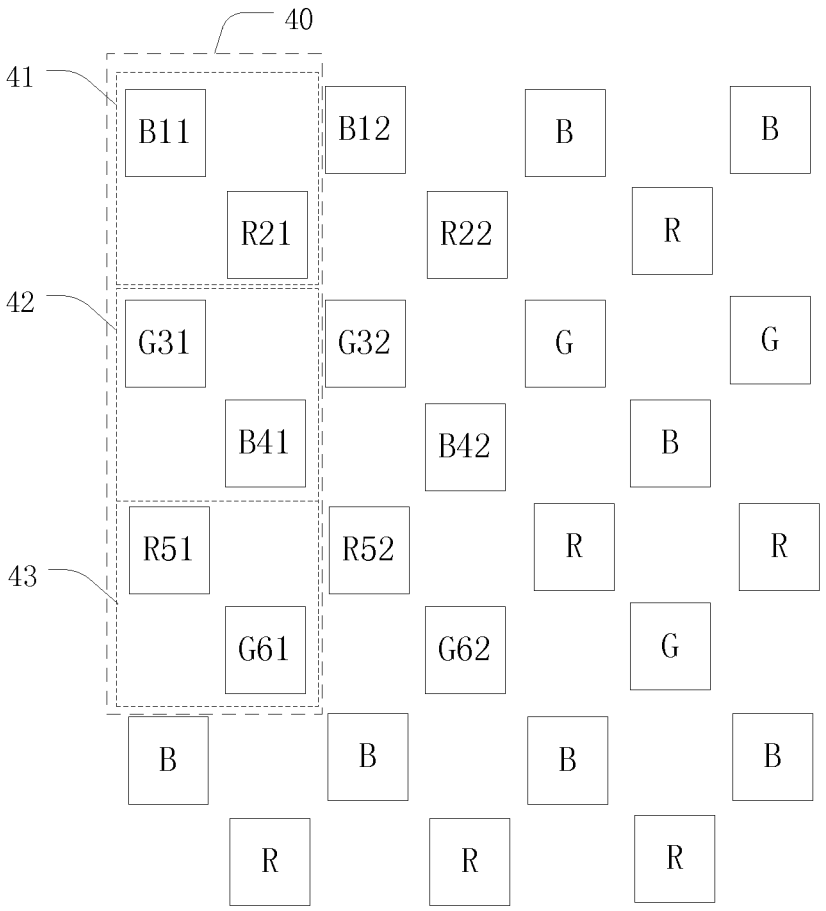
FIG. 4(*a*) is a schematic diagram showing a pixel array according to a first embodiment of the present disclosure.
Figure 4B:
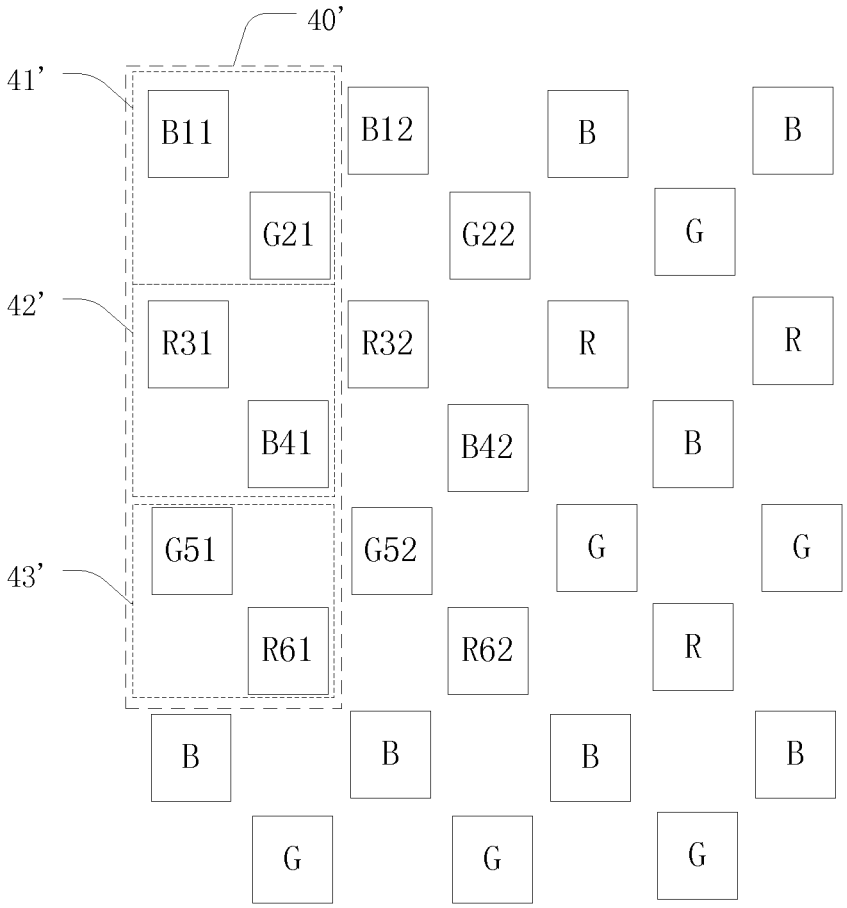

FIG. 4(*a*) is a schematic diagram showing a pixel array according to a first embodiment of the present disclosure. As shown in FIG. 4(*a*), the pixel array is composed of a plurality of basic pixel units which are repeated in a horizontal direction and a vertical direction. Each basic pixel unit 40 include a first pixel point 41, a second pixel point 42 and a third pixel point 43 which are arranged from top to bottom. The first pixel point 41 is composed of a blue sub-pixel B11 and a red sub-pixel R21 which are respectively located in two horizontal rows. The second pixel point 42 is composed of a green sub-pixel G31 and a blue sub-pixel B41 which are respectively located in two horizontal rows. The third pixel point 43 is composed of a red sub-pixel R51 and a green sub-pixel G61 which are respectively located in two horizontal rows. The blue sub-pixel B11 in the first pixel point 41, the green sub-pixel G31 in the second pixel point 42, and the red sub-pixel R51 in the third pixel point 43 are arranged in sequence from top to bottom in the vertical direction at a first interval to form a first column. The red sub-pixel R21 in the first pixel point 41, the blue sub-pixel B41 in the second pixel point 42, and the green sub-pixel G61 in the third pixel point 43 are arranged in sequence from top to bottom in the vertical direction at the first interval so as to form a second column. The second column is separated from the first column by a second interval in the horizontal direction.

More specifically, the first interval is smaller than a height of one sub-pixel. That is, an interval between the blue sub-pixel B11 in the first pixel point 41 and the green sub-pixel G31 in the second pixel point 42 is smaller than a height of one sub-pixel; an interval between the green sub-pixel G31 in the second pixel point 42 and the red sub-pixel R51 in the third pixel point 43 is also smaller than a height of one sub-pixel. Similarly, an interval between the red sub-pixel R21 in the first pixel point 41 and the blue sub-pixel B41 in the second pixel point 42 is also smaller than a height of one sub-pixel; an interval between the blue sub-pixel B41 in the second pixel point 42 and the green sub-pixel G61 in the third pixel point 43 is also smaller than a height of one sub-pixel.

More specifically, the second interval is greater than or equal to zero. That is, a horizontal interval between two sub-pixels which are located at positions corresponding to one another in two adjacent basic pixel units in the horizontal direction of the pixel array, is greater than or equal to a width of one sub-pixel. For example, as shown in this figure, in the first row, an interval between the blue sub-pixel B11 in the first pixel point 41 and a blue sub-pixel B12 in an adjacent pixel point in the horizontal direction is greater than or equal to a width of one sub-pixel, so that the interval in the horizontal direction between the blue sub-pixel B11 and the red sub-pixel R21 in the first pixel point is greater than or equal to zero.

More specifically, a vertical interval between two sub-pixels which are located at positions corresponding to one another in two adjacent basic pixel units in the vertical direction of the pixel array, is smaller than a height of five sub-pixels. For example, as shown in this figure, an interval between the blue sub-pixel B11 of the first pixel point 41 in the first row and a blue sub-pixel B (the first B in the seventh row as shown in this figure) of a first pixel point in an adjacent basic pixel unit in the vertical direction is smaller than a height of five sub-pixels, so that an interval in the vertical direction between the blue sub-pixel B11 in the first pixel point 41 and the green sub-pixel G31 in the second pixel point 42 and an interval in the vertical direction between the green sub-pixel G31 in the second pixel point 42 and the red sub-pixel R51 in the third pixel point 43 are smaller than a height of one sub-pixel, respectively (although the interval as shown in this figure is approximately equal to a height of one sub-pixel).

More specifically, the first pixel point 41, the second pixel point 42 and the third pixel points 43 corresponds to the pixel point 210 shown in FIG. 2. Since the interval between two adjacent blue sub-pixels in the row direction, the interval between two adjacent red sub-pixels in the row direction and the interval between two adjacent green sub-pixels in the row direction is greater than or equal to a width of one sub-pixel, the blending color will not be occurred between sub-pixels B11 and R21 forming the first pixel 41, color mixture will not occur between the sub-pixels B11 and R21 that constitute the pixel point 41, between the sub-pixels G31 and B41 that constitute the pixel point 42 and between the sub-pixels R51 and G61 that constitute the pixel point 43. Since only three primary colors can form all colors and two colors cannot form all colors, when an image is actually displayed, one pixel point may "borrow" one color of an adjacent pixel unit to form the three primary colors. If scanning is performed by row from top to bottom, since the pixel point 42 lacks a red sub-pixel, the pixel point 42 may borrow the red sub-pixel R21 from the upper pixel point 41 which is adjacent to the pixel point 42 in the vertical direction. Thus, each pixel point shares a sub-pixel having a color absent in the pixel point with an adjacent pixel point in the vertical direction so as to cooperatively realize a white display effect.

In FIG. 4(*a*), each sub-pixel is arranged in a straight line with a sub-pixel at the upper left and a sub-pixel at the lower right, and an angle between this straight line and the horizontal direction is 45°, for example. In this way, a sub-pixel adjacent to two sub-pixel rows, is positioned at a midpoint in the vertical direction between two sub-pixels that are adjacent to the sub-pixel and are respectively in a preceding sub-pixel row and a next sub-pixel row.

In the embodiment illustrated in FIG. 4(*a*), shapes of respective sub-pixels are rectangle and sizes of respective sub-pixels are the same. However, the shapes and the sizes of respective sub-pixels are not limited to this. Accordingly, the present disclosure may have the following modifications according to a second embodiment to a sixth embodiment.

FIG. 4(*b*) is a schematic diagram showing a pixel array according to the second embodiment of the present disclosure. The second embodiment shown in FIG. 4(*b*) differs from the first embodiment shown in FIG. 4(*a*) only in that the positions of red sub-pixels and green sub-pixels are reversed.

Accordingly, a pixel point 41' is composed of the first blue sub-pixel B11 from left in the first row and the first green sub-pixel G21 from left in the second row; a pixel point 42' is composed of the first red sub-pixel R31 from left in the third row and the first blue sub-pixel B41 from left in the fourth row.

Figure 5A:
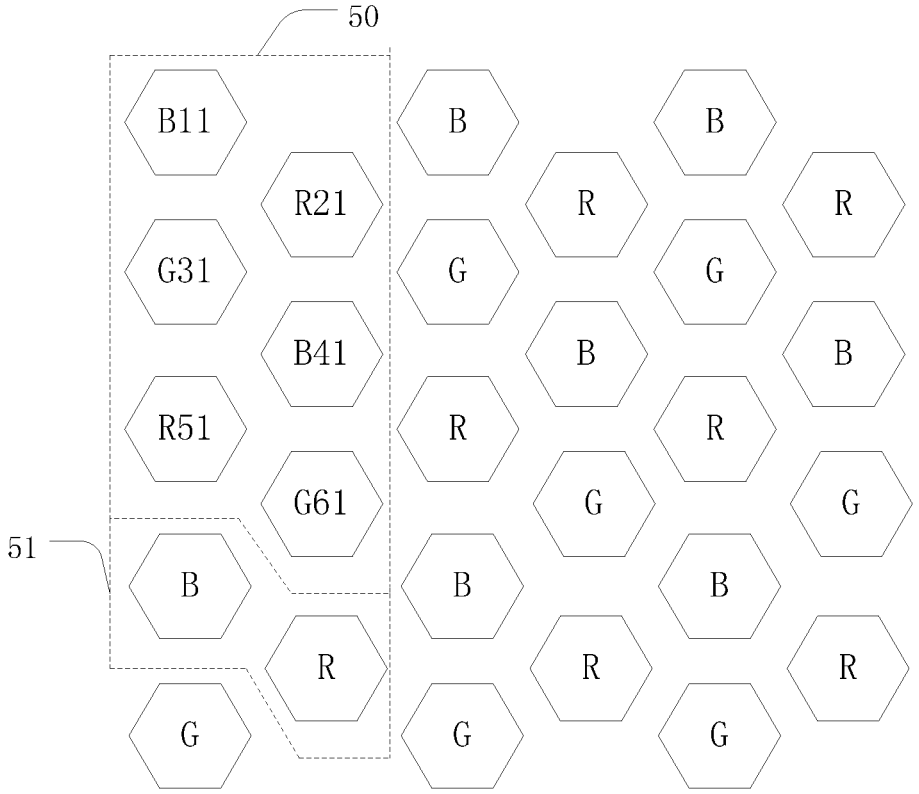
FIG. 5(*a*) is an exemplary schematic diagram showing a pixel array according to a third embodiment of the present disclosure.
Figure 5B:
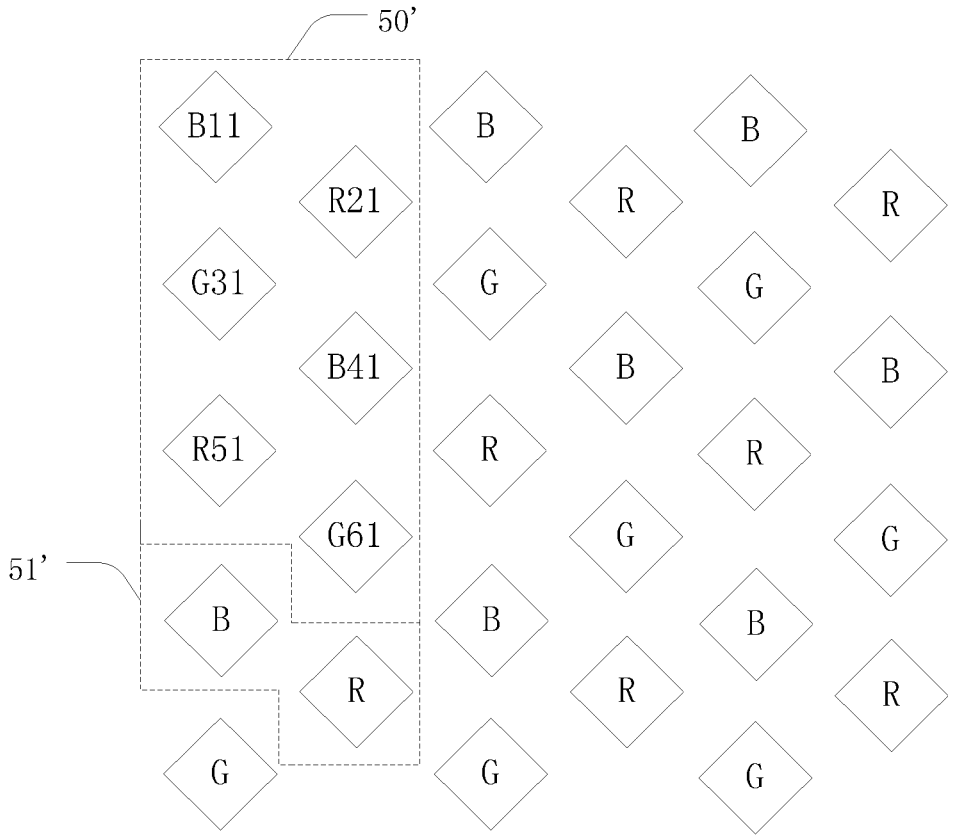
Figure 5C:
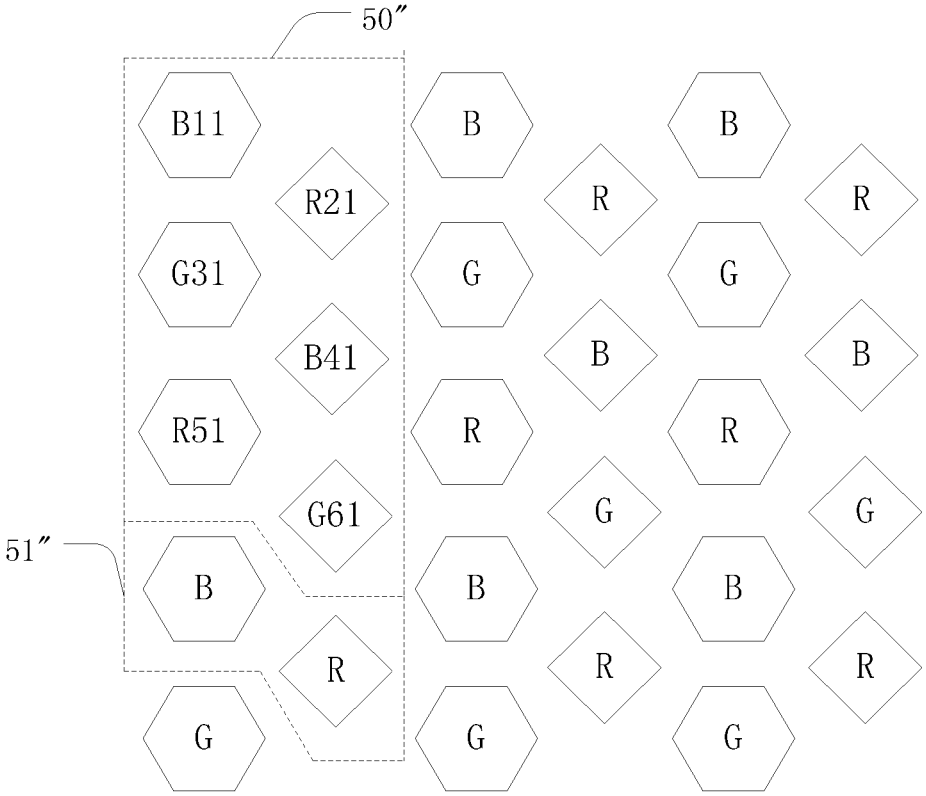

FIG. 5(*a*) is a schematic diagram showing a pixel array according to the third embodiment of the present disclosure. The third embodiment shown in FIG. 5(*a*) differs from the first embodiment shown in FIG. 4(*a*) only in that the shapes of the blue sub-pixels, the red sub-pixels and the green sub-pixels are regular hexagon. Specifically, a basic pixel unit is indicated by a reference number 50 and a pixel point is indicated by a reference number 51.

FIG. 5(*b*) is a schematic diagram showing a pixel array according to the fourth embodiment of the present disclosure. The fourth embodiment shown in FIG. 5(*b*) differs from the first embodiment shown in FIG. 4(*a*) only in that the shapes of the blue sub-pixels, the red sub-pixels and the green sub-pixels are diamond. Specifically, a basic pixel unit is indicated by a reference number 50' and a pixel point is indicated by a reference number 51'.

FIG. 5(*c*) is a schematic diagram showing a pixel array according to the fifth embodiment of the present disclosure. The fifth embodiment shown in FIG. 5(*c*) differs from the first embodiment shown in FIG. 4(*a*) only in that the shapes of the blue sub-pixels and the green sub-pixels are regular hexagon and the shapes of the red sub-pixels are diamond. Specifically, a basic pixel unit is indicated by a reference number 50" and a pixel point is indicated by a reference number 51".

Figure 6:
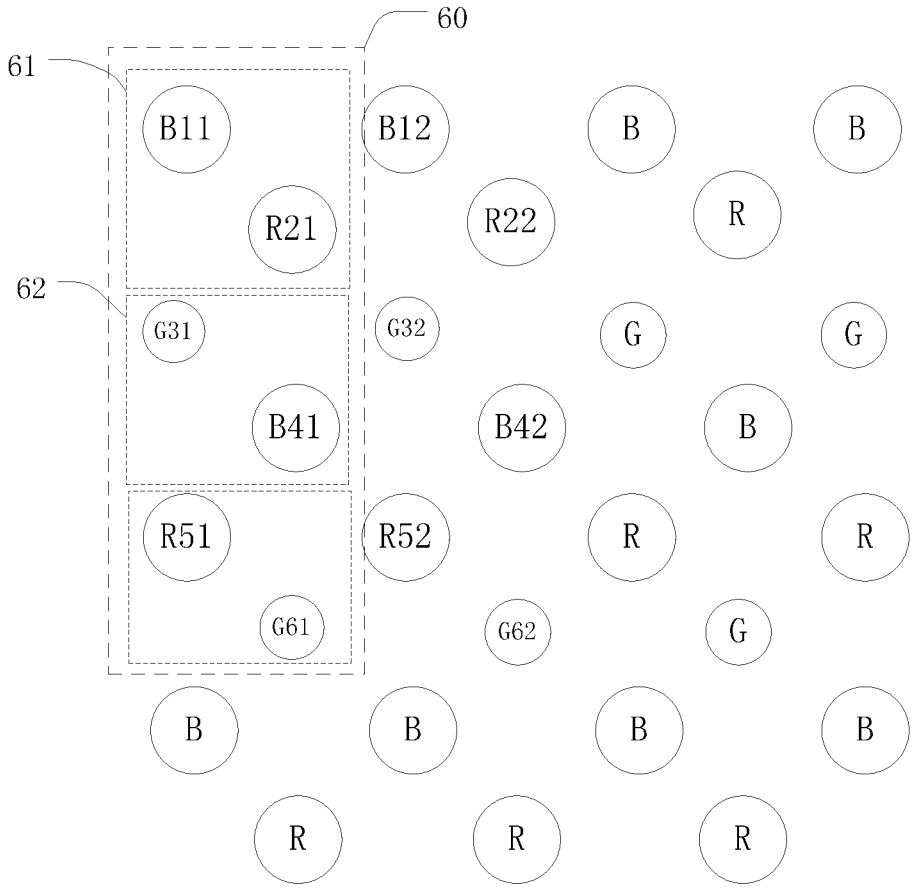
FIG. 6 is a schematic diagram showing a pixel array according to a sixth embodiment of the present disclosure.

FIG. 6 is a schematic diagram showing a pixel array according to the sixth embodiment of the present disclosure. Specifically, a basic pixel unit is indicated by a reference number 60 and pixel points are indicated by reference numbers 61 and 62. As shown in FIG. 6, shapes of respective sub-pixels are circular, an area of a blue sub-pixel B is equal to an area of a red sub-pixel R, and an area of a green sub-pixel G is 75%~85% to an area of a blue sub-pixel B. This is because of the characters of the green sub-pixels that the green sub-pixels may play the same role even without the same sizes as other sub-pixels. As shown in FIG. 6, the pixel point 62 includes a green sub-pixel G31 and a blue sub-pixel B41 and lacks a red sub-pixel. Thus, when scanning is performed by row from top to bottom, the pixel point 62 may borrow a red sub-pixel R21 from the pixel point 61 above the pixel point 62.

In the pixel array of the present disclosure, respective sub-pixels may have other shapes such as regular hexagon in addition to circle, rectangle and diamond.

The present disclosure provides a display which includes a base, an OLED and a driver. The base has a pixel area and a non-pixel area. The OLED is located in the pixel area and includes a first electrode, an organic film layer and a second electrode. The driver is configured to drive the OLED. The pixel array in the pixel area of the display may be anyone of the pixel arrays according to the embodiments of the present disclosure as shown in FIGS. 3-6.

Figure 7:
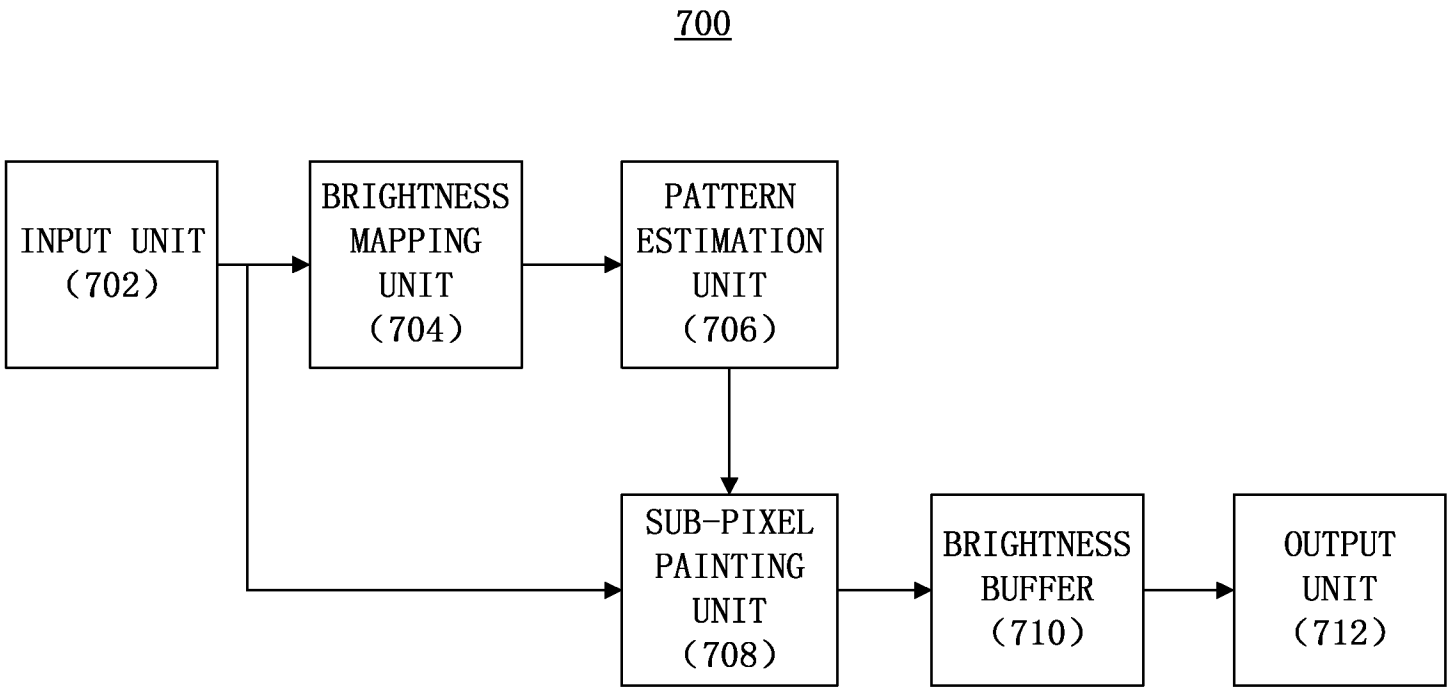
FIG. 7 illustratively shows a driver for presenting a color image on the display according to the present disclosure.

FIG. 7 illustratively shows a driver 700 for presenting a color image on the display according to the present disclosure. The driver 700 includes an input unit 702, a brightness mapping unit 704, a pattern estimation unit 706, a sub-pixel painting unit 708, a brightness buffer 710 and an output unit 712. The input unit 702 is configured to input image signals representative of the color image to be presented on the display. The brightness mapping unit 704 is configured to generate a brightness map for the color image. The brightness map includes brightness values of each of red color, green color and blue color. The pattern estimation unit 706 is configured to analyze the brightness map to estimate at least one pattern of the color image. The at least one pattern of the color image includes at least one of a dot pattern, a vertical line, a horizontal line and a diagonal line. The pattern estimation unit 706 is configured to generate at least one color template for each pattern. The sub-pixel painting unit 708 is configured to generate an intensity map according to the at least one color template and output the intensity map to the brightness buffer 710. The intensity map includes intensity values of each first sub-pixel, each second sub-pixel and each third sub-pixel of the display. The output unit 712 is configured to output a plurality of voltage signals generated according to the intensity map to the display.

The driver 700 may further be configured to generate the intensity map directly from the input image signals without using the brightness mapping unit 704 and the pattern estimation unit 706.

In the pixel arrays according to the embodiments of the present disclosure, various color templates may be generated. A color template is determined according the color of the dot pattern so as to display various patterns in an image. Each of a first brightness value, a second brightness value and a third brightness value is a ratio of a grayscale value (brightness) of a respective color to its maximum grayscale value and is expressed as a percentage ranging from 0% to 100%. For example, for an n-bit grayscale of a color, the grayscale value takes values from zero representing no such a color, up to ($2^n-1$) representing the full color. The former has a brightness value of 0%, while the latter has a brightness value of 100% of the color. The brightness values may be based on a 8-bit color grayscale, i.e., the grayscale value takes values from 0, 1, 2, . . . , 254 to 255. It shall be understood that, other bit grayscales can also be utilized to practice the present disclosure. The grayscale value refers to shades of gray for an image, or an amount of light perceived by human eyes for the image. If the brightness of the color image is expressed in the form of shades of grey in n bits, n being an integer greater than zero, the gray level takes values from "zero" representing black, up to "$2^n-1$" representing white, with intermediate values representing increasingly light shades of gray.

For example, in order to display a white dot pattern, a color template may include: a green brightness value about 100%; a blue brightness value ranging from about 50% to about 100%; and a red brightness value ranging from about 50% to about 100%. In order to display a red dot pattern, a color template may include: a green brightness value ranging from about 1% to about 20%; a blue brightness value ranging from about 0% to about 50%; and a red brightness value ranging from about 50% to about 100%. In order to display a green dot pattern, a color template may include: a green brightness value of 100%; a blue brightness value ranging from about 0% to about 50%; and a red brightness value ranging from about 1% to about 30%. In order to display a blue dot pattern, a color template may include: a green brightness value ranging from about 1% to about 20%; a blue brightness value ranging from about 50% to about 100%; and a red brightness value ranging from about 0% to about 30%.

Figure 8:
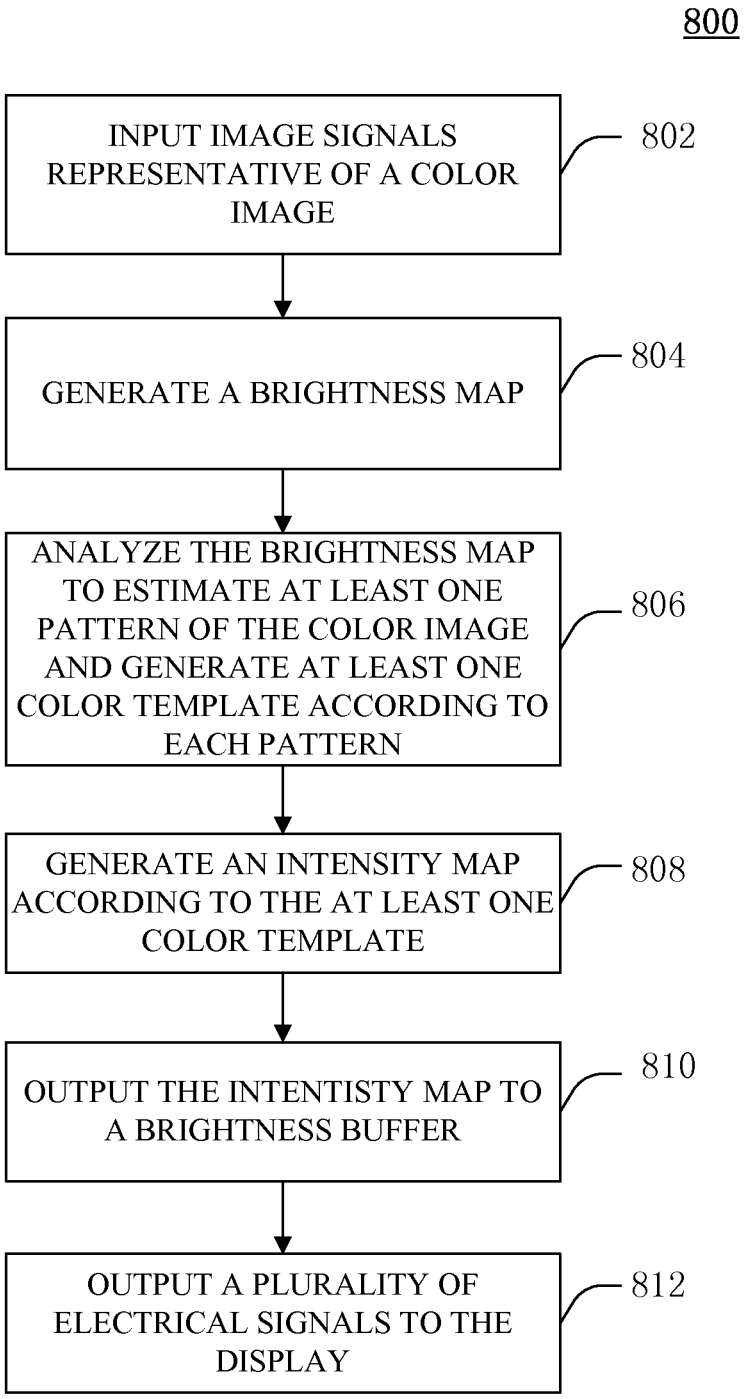
FIG. 8 illustratively shows a method for presenting an image on the display according to the present disclosure.

FIG. 8 illustratively shows a method 800 for presenting an image on a display according to the present disclosure. The method 800 may include the following steps.

At step 802, image signals are input. The image signals may be image signals representative of a color image, for example.

At step 804, a brightness map is generated according to the input image signals. The brightness map includes brightness values of each red sub-pixel, each green sub-pixel and each blue sub-pixel.

At step 806, the brightness map is analyzed to estimate at least one pattern of the color image, and at least one color template is generated according to each pattern. The color template has a plurality of sub-pixels and each of the at least one color template is corresponding to the at least one pattern of the color image.

At step 808, an intensity map is generated according to the at least one color template. The intensity map includes intensity values of each first sub-pixel, each second sub-pixel and each third sub-pixel of the display.

At step 810, the intensity map is output to a brightness buffer.

At step 812, a plurality of electrical signals generated according to the intensity map is output to the display.

The method 800 may also be configured to generate the at least one color template directly from the input image signals without steps 804 and 806.

One of ordinary skill in this art shall appreciate that modifications and variations without departing from the sprit and scope of the present disclosure as disclosed by appended claims shall fall within the protection scope of claims of the present disclosure.

What is claimed is:

1. A method for presenting an image on a display, wherein the display has a pixel array which is composed of a plurality of basic pixel units which are repeated in a horizontal direction and a vertical direction, wherein each of the basic pixel units comprises a first pixel point, a second pixel point and a third pixel point which are arranged from top to bottom, the first pixel point is composed of a first sub-pixel of a first color and a second sub-pixel of a second color which are respectively located in two different horizontal rows, the second pixel point is composed of a third sub-pixel of a third color and a first sub-pixel of the first color which are respectively located in two different horizontal rows, and the third pixel point is composed of a second sub-pixel of the second color and a third sub-pixel of the third color which are respectively located in two different horizontal rows, wherein:

the first sub-pixel in the first pixel point, the third sub-pixel in the second pixel point, and the second sub-pixel in the third pixel point are arranged in sequence from top to bottom in the vertical direction at a first interval to form a first column;

the second sub-pixel in the first pixel point, the first sub-pixel in the second pixel point, and the third sub-pixel in the third pixel point are arranged in sequence from top to bottom in the vertical direction at the first interval to form a second column; and the second column is separated from the first column by a second interval in the horizontal direction;

wherein the method comprises:

(a) inputting image signals representative of a color image to be presented on the display;

(b) generating an intensity map which comprises intensity values of each first sub-pixel, each second sub-pixel and each third sub-pixel of the display; and (c) outputting a plurality of electrical signals generated according to the intensity map to the display;

wherein, after step (a) and before step (b), the method further comprises:

generating at least one color template, wherein the at least one color template is used to generate the intensity map;

wherein the color template comprises:

a first sub-pixel at a center of the color template and having a first brightness value;

a second sub-pixel in a sub-pixel row next to the first sub-pixel and having a second brightness value; and a third sub-pixel in a sub-pixel row preceding the first sub-pixel and having a third brightness value;

wherein the first sub-pixel and the second sub-pixel in the color template form a pixel point; and wherein each pixel point shares a sub-pixel having a color absent in the pixel point with an adjacent pixel point in the vertical direction so as to cooperatively realize a white display effect.

2. The method according to claim 1, wherein, after step (b) and before step (c), the method further comprises:

receiving and buffer the intensity map.

3. The method according to claim 1, wherein the first interval is smaller than a height of one sub-pixel.

4. The method according to claim 3, wherein the second interval is greater than or equal to zero.

5. The method according to claim 1, wherein a horizontal interval between two sub-pixels which are located at positions corresponding to one another in two adjacent basic pixel units in the horizontal direction of the pixel array, is greater than or equal to a width of one sub-pixel.

6. The method according to claim 5, wherein a vertical interval between two sub-pixels which are located at positions corresponding to one another in two adjacent basic pixel units in the vertical direction of the pixel array, is smaller than a height of five sub-pixels.

7. The method according to claim 1, wherein the first sub-pixel, the second sub-pixel and the third sub-pixel respectively have a shape selected from a group consisting of rectangle, circle, diamond and regular hexagon.

8. The method according to claim 3, wherein the first color, the second color and the third color are blue, red and green respectively.

9. The method according to claim 3, wherein the first color, the second color and the third color are blue, green and red respectively.

10. The method according to claim 4, wherein an area of the first sub-pixel is equal to an area of the second sub-pixel, and an area of the third sub-pixel is 75%~85% to the area of the first sub-pixel.

11. The method according to claim 1, wherein a row of sub-pixels having the same color are provided with signals by a scan driver, and a column of sub-pixels having different colors are provided with signals by a data driver.

12. The method according to claim 1, wherein the generating of the at least one color template comprises generating the at least one color template directly from the input image signals.

13. The method according to claim 1, wherein the generating of the at least one color template comprises:

generating a brightness map of the color image, wherein the brightness map comprises brightness values of each first sub-pixel, each second sub-pixel and each third sub-pixel; and analyzing the brightness map to estimate at least one pattern of the color image and generating the at least one color template for each pattern;

wherein the at least one pattern comprises a dot pattern.

* * * * *